United States Patent [19]

Fosse

[11] Patent Number: 4,860,887

[45] Date of Patent: Aug. 29, 1989

[54] METHOD OF FORMING PACKAGING AND PACKAGING STRUCTURE IN ACCORDANCE WITH THE METHOD

[76] Inventor: Daniel K. Fosse, 361 104th Ln., Coon Rapids,. Minn. 55433

[21] Appl. No.: 222,950

[22] Filed: Jul. 22, 1988

[51] Int. Cl.[4] ..... B65D 81/26

[52] U.S. Cl. ..... 206/204; 426/431

[58] Field of Search ..... 206/204; 426/431; 428/35; 220/460

[56] References Cited

U.S. PATENT DOCUMENTS

| | | | |
|---|---|---|---|
| 3,156,402 | 11/1964 | DuPuis | 206/204 |
| 4,382,507 | 5/1983 | Miller | 206/204 |
| 4,579,223 | 4/1986 | Otsuka et al. | 206/204 |
| 4,686,776 | 8/1987 | Matsubara | 206/204 |
| 4,735,308 | 4/1988 | Barner | 206/204 |
| 4,801,006 | 1/1989 | Martin et al. | 206/204 |

*Primary Examiner*—Joseph Man-Fu Moy

*Attorney, Agent, or Firm*—Lawrence M. Nawrocki

[57] ABSTRACT

A method of securing a soaker pad (20, 30) to an expanded polystyrene tray (10) for the display of meat products. The method includes securing the soaker pad (20, 30) to the tray (10) at discrete, spaced locations (40) by employing sonic welding to weld a polyethylene lamina or laminae (24, 24', 34, 34') of the soaker pad (20, 30) to the tray (10).

8 Claims, 1 Drawing Sheet

METHOD OF FORMING PACKAGING AND PACKAGING STRUCTURE IN ACCORDANCE WITH THE METHOD

TECHNICAL FIELD

The present invention deals broadly with the field of packaging products. More specifically, however, it deals with packaging for meat products and the like. Meat products typically are displayed in, for example, supermarkets in trays made of expanded polystyrene. For both aesthetic and sanitary reasons, a soaker pad is received within the tray underlying the meat product. The soaker pad absorbs liquids exuded by the meat. The invention of the present document deals with the affixation of the soaker pad to the expanded polystyrene tray to secure the pad in place.

BACKGROUND OF THE INVENTION

As technology has progressed, sellers of meat products have been able to make a transition from having to sell, for example, the live chicken to being able to sell cuts and portions of slaughtered animals. Such cuts and parts are typically, of course, maintained frozen in order to preclude bacteriological degradation. With time, the sellers adopted refrigerated vehicles wherein the cuts and parts were maintained frozen by using ice and "dry ice".

Certainly, however, employing such a method to ensure maintaining the meats in a frozen state have drawbacks. Regardless of what freezing agent is employed, it will dissipate over time, particularly when temperatures are high.

With the advent of the supermarket, butchering of the animals came to take place in the same location at which the meat products were presented for sale. The animals were butchered, packaged, and immediately placed in locations where the consumer could choose a particular cut of meat or poultry parts he desired to purchase. Temperatures in the coolers could be maintained at optimum levels, and, in any case, no more packages than could be expected to be purchased in a reasonable time in which bacteriological degradation would not occur were prepared. As the supply of a particular cut became low, the one-site butcher would prepare additional packaged cuts to replace those purchased.

The sides of beef or chickens to be prepared for sale, in such circumstances, can be maintained in freezers, if they need be maintained for a relatively extended period of time before being cut into portions for presentation to the consumer. Maintenance of the meat products can, thereby, be extended for significant periods of time.

Typically, supermarkets present a meat product for sale at a temperature above freezing. By doing so, the products can be given a more appealing appearance, and they are available for immediate preparation by the consumer, if necessary.

In view of this temperature regulation, blood and other liquids exuded from the meat products can collect in the packaging in which the products are wrapped for presentation to the consumer. It is common to employ expanded polystyrene trays to hold the meat cuts or parts. After the meat is place in a tray, the tray is wrapped with, for example, cellophane or a similar film-like wrap. Without means being provided to absorb the liquids, the liquids tend to collect in a puddle in the bottom of the tray, and the meat remains in the puddle.

Under such conditions, the products presented for sale are unsitely and unappetizing More importantly, however, the meat can be rendered unhealthy because of bacteriological development. It has been found that blood and other liquid by-products provide a fertile medium for bacterial growth. When no attempt is made to segregate the liquid by-products from the cut of meat, the meat will tend to deteriorate rapidly. Such circumstances not only present dangers to health and well-being of the consumers, but they also give rise to lost profits, even if the consuming public is adequately protected.

In attempting to resolve these problems, the meat marketing industry has developed soaker pads for absorbing the exudants. Such soaker pads typically incorporate an absorbent material such as cellulose paper. A layer of such absorbent material is placed on the floor of the tray into which the meat product is to be placed. A lamina of substantially impermeable material such as polyethylene overlies the cellulose, absorbent material to segregate the meat product placed in the tray from the liquid by-products absorbed by the cellulose paper.

A typical soaker pad includes an absorbent material and overlying lamina which are integrally formed. The pad is placed on the floor of the tray with the polyethylene outer lamina facing upwardly. The pad is dimensioned so that it fits to generally cover the full floor of the tray. The meat product is then placed on the polyethylene lamina.

As liquids are exuded from the meat, they pass over the polyethylene sheet and down into crevices defined between the edges of the soaker pad and the side walls of the tray. As this occurs, the absorbent material becomes exposed to the exudants, since the edges of the soaker pad are not covered by the polyethylene. A "wicking" action occurs, and the liquid exudants are absorbed by the cellulose paper fiber material.

While a number of the problems inherent in the sale of meat products are solved by such a structure, others are created. For example, while the pad, if it is properly seated on the floor of the tray, can efficiently function to absorb exudants, if the pad becomes crumpled or shifts so that a significant portion becomes elevated from the floor of the tray, much of the absorbent power of the pad becomes lost. Further, that portion of the floor of the tray no longer covered by the pad will enable puddling of exudants, and bacteriological deterioration of the meat products will occur.

Attempts have been made to ensure that the soaker pad is maintained in its proper position within the expanded polystyrene tray. The thrust of these efforts is the employment of an adhesive, spread or spotted at spaced locations on the underside of the pad, to effect affixation. This suggested solution has, however, proven generally unacceptable. Care must be taken to ensure that the adhesive selected is not one that would created health dangers because of its chemical composition.

Additionally, the adhesive must be of a character wherein it does not dissolve or is not rendered incapable of accomplishing affixation when it becomes flooded by the liquid meat by-products. Even when adhesives believed to be acceptable are employed, shifting of the soaker pad can still result. Because of the nature of the absorbent cellulose paper fibers, fiber separation can occur and dislodgement of the soaker pad result.

Attempts have been made to secure the soaker pad in other manners. For example, U.S. Pat. No. 4,552,600 (Laiewski et al.) has suggested securing a thermoplastic sheet to a raised shoulder area of a tray for display of meats. The boarder area of the thermoplastic film is, in that patent, secured to the shoulder of the tray by heat sealing. The seal is intended to be liquid-tight.

This solution, however, is also unacceptable. Heat sealing over large areas of an expanded polystyrene tray has been found to work deleterious effects upon the tray.

It is to these problems of the prior art that the present invention is directed. It is an improved method for securing a soaker pad to an expanded polystyrene tray.

SUMMARY OF THE INVENTION

The present invention includes both a method and a packing product made in accordance with the method. The method includes a step of providing an expanded polystyrene tray, as known in the art. A soaker pad, including a lamina made of polyethylene, is placed into a recess defined in the tray. The soaker pad is secured to the tray by sonically welding the polyethylene lamina to the polystyrene tray at a plurality of discrete locations at the interface between the polystyrene lamina and tray.

Typically, such trays are generally rectangular. When the tray is so shaped, the soaker pad would be cut to a size and shape to substantially correspond to the size and shape of the floor of the tray. When a tray and soaker pad so configured are employed, sonic welding would appropriately be effected at each of the four corners of the pad.

The method invention envisions employment of a soaker pad utilizing a layer of absorbent material such as cellulose paper fibers. The absorbent layer is enclosed within an envelope of micro-perforated polyethylene. The periphery of the envelope is sealed, and the sealed seam can function to provide locations at which sonic welding can be effected.

Since the absorbent material becomes sealed within the envelope of polyethylene, an upper lamina of the envelope is, as previously indicated, micro-perforated. The exudants from the meat product to be placed in the soaker pad-provided tray will pass through the micro-perforations and be absorbed by the fibrous absorbent material.

The invention also envisions a packaging product formed in accordance with the method. The packaging product includes an expanded polystyrene tray with a recess defined therein. Further, it includes a soaker pad received in the recess, the soaker pad including a polyethylene lamina. The polyethylene lamina is sonically welded to the tray at a plurality of discrete, spaced locations about the periphery of the lamina.

The present invention is thus an improved meat product display tray and soaker pad combination. More specific features and advantages obtained in view of those features will become apparent with reference to the DETAILED DESCRIPTION OF THE INVENTION, the appended claims, and the accompanying drawing figures.

DETAILED DESCRIPTION OF THE INVENTION

Figure 1:
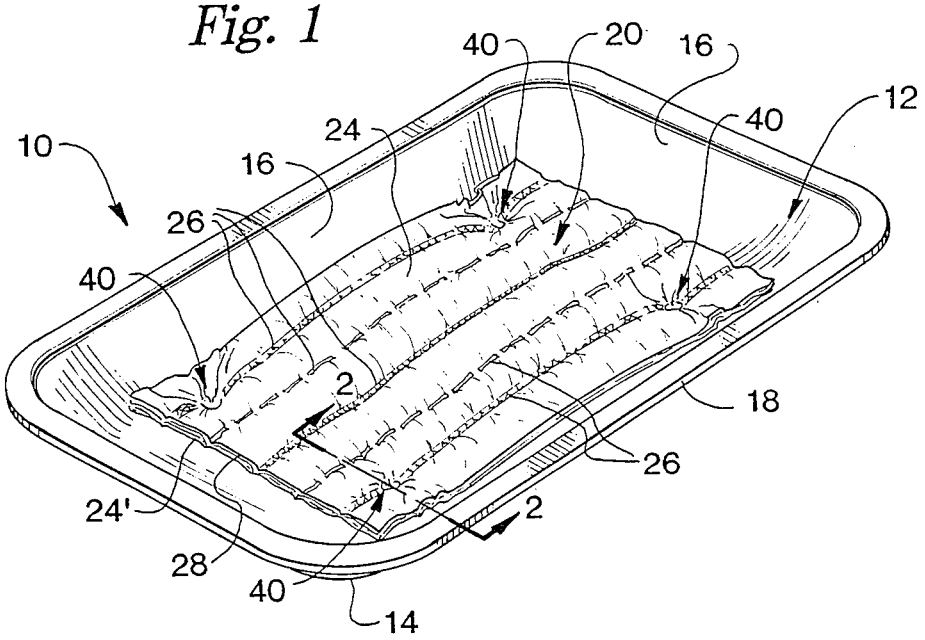
FIG. 1 is a perspective view of a meat product tray in accordance with the present invention.

Referring now to the drawing wherein like reference numerals denote like elements throughout the several views, FIG. 1 shows a meat product packaging tray 10 of a type as used in the prior art. The tray 10 includes a recess 12 defined therewithin by a floor 14 of the tray 10 and upwardly-extending, outwardly-sloping side walls 16. The outer periphery, at the upper extremity of the side walls 16, is defined by an outwardly-extending lip 18.

Typically, such trays 10 are made of an expanded polystyrene material. It will be understood, however, that, although it is a tray 10 made of this particular type of material that the present invention contemplates employing, trays of other materials are envisioned as being able to be utilized.

Figure 2:
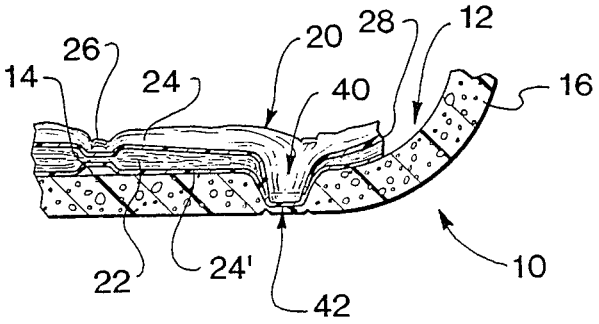
FIG. 2 is an enlarged fragmentary sectional detail view taken generally along line 2—2 of FIG. 1.
Figure 3:
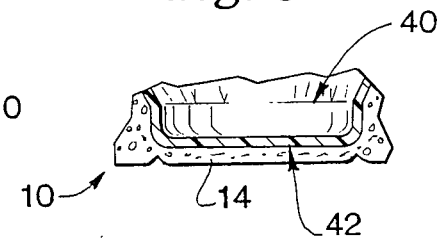
FIG. 3 is greatly enlarged detail view of the area encircled at 3 in FIG. 2.

FIGS. 1 and 2 illustrate the soaker pad 20 of a type known in the prior art being received within the recess 12 in the tray 10. The tray 10 shown in FIG. 1 has a recess 12 with a generally rectangularly shaped floor 14. The soaker pad 20 used with that tray is shaped and sized to approximate the floor 14 of the tray 10. The soaker pad 20 comprises a layer of cellulose paper fiber absorbent material 22. In the particular embodiment illustrated in FIGS. 1 and 2, the absorbent material 22 is sandwiched between two layers of polyethylene film 24, 24'. The pad 20 thereby created is tacked longitudinally at spaced intervals, as at 26, in order to maintain the pad 20, as much as possible, in a unitary construction.

Edges 28 of the soaker pad 20 are cut to leave the absorbent cellulose paper fiber material 22 exposed. As a result, when a meat product (not shown) is placed in the tray 10 and liquid by-products are exuded thereby, a "wicking" action will occur whereby the liquids will be soaked up by the absorbent material 22 and the liquids will be conveyed inwardly away from the edges 28 of the pad 20.

The polyethylene laminae 24, 24' sandwiching the absorbent material 22 therebetween is substantially impermeable to the passage of liquids. Consequently, as the absorbent material 22 soaks up the liquids exuded by the meat product, those liquids will be segregated from the meat product by the upper layer 24 of polyethylene film. Bacteriological growth that might occur because of the exudants will, thereby, be inhibited from contaminating the meat product.

Figure 4:
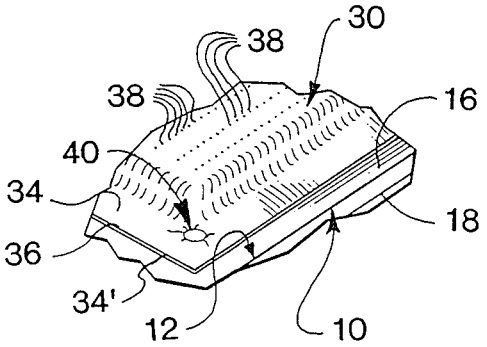
FIG. 4 is a fragmentary perspective view of a soaker pad in accordance with the invention in place in a packaging tray.

It will be understood that the particular soaker pad 20 construction illustrated in FIGS. 1 and 2 is not the only one appropriatable for use in the present invention. Other types of pads can be employed and accomplish the same result. FIG. 4 illustrates a specially designed soaker pad 30 which particularly lends itself to employment in the present method. The soaker pad 30 of that figure is one wherein a layer of absorbent material is, as in the case of the soaker pad 20 of FIGS. 1 and 2, sandwiched between two laminae 34, 34' of polyethylene film. The layers of polyethylene 34, 34', however, extend laterally beyond the edges of the absorbent cellulose fiber paper. They are sealed at their interfaces, as at 36, to define an envelope which encloses the absorbent wad.

Because of the construction of this type of soaker pad 30, wicking does not occur at the edges thereof. Consequently, at least the upper layer 34 of polyethylene film is provided with a multiplicity of micro-perforations 38. These micro-perforations 38 permit passage of the liquid exudants therethrough. After passage through the micro-perforations 38, however, the exudants are absorbed by the wad of absorbent material. The liquids, consequently, are precluded from passing outwardly through the micro-perforations 38, and acceptable segregation of the exudants from the meat product being displayed is provided.

The present invention employs novel means of securing the pad to the expanded polystyrene tray. The method employs sonic welding as the means for securing the two components together. A sonic welding tool (not shown) can be brought into engagement with the soaker pad at desired, discrete locations thereon 40. The tool effects a melding of the polyethylene 24, 34 of the soaker pad 20, 30 and the expanded polystyrene of the tray 10.

A compressed form 42 of the soaker pad and the expanded polystyrene tray, at each point of welding 40, results. The sonic welding tool effects vibration of the molecules of the various component parts and, as pressure is applied, the melding occurs.

FIG. 1 illustrates a soaker pad 20 secured at four discrete locations. In view of the rectangular nature of the soaker pad 20, welding is effected proximate each corner thereof. The specific number and locations of welding, however, are not important other than that they ensure secure retention of the pad 20 so that slippage and crumpling is precluded.

It is important to the invention that welding is done at discrete, spaced locations 40, however. It has been found that attempting to weld large areas has deleterious effects upon the expanded polystyrene tray 10. While welding at discrete locations 40 effects acceptable securing of the soaker pad 20 to the tray 10 without allowing for leakage because of cracks formed in the tray 10, welding over large areas diminishes the ability of the tray 10 to retain the liquids. At a minimum, minor cracks are introduced when such welding is attempted. At worst, the tray 10 becomes totally unusable.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A method of forming a packaging for meat products and the like, comprising the steps of:

(a) providing a tray, as known in the art, made of expanded polystyrene;

(b) placing a soaker pad, including a lamina made of polyethylene, into a recess defined in the tray; and (c) securing the soaker pad to the tray by sonic welding the polyethylene lamina to the expanded polystyrene tray at a plurality of discrete locations at their interface.

2. The method in accordance with claim 1 wherein the recess in the tray is generally rectangular and the soaker pad is sized and shaped to be received within the generally rectangular recess in the tray, and wherein the step of securing the soaker pad to the tray includes sonic welding the polyethylene lamina to the expanded polystyrene tray at each of four corners of the pad.

3. The method in accordance with claim 2 comprising a further step of providing a soaker pad having a wad of absorbent material enclosed by an envelope of micro-perforated polyethylene, the envelope having a sealed periphery at which said step of sonic welding is performed.

4. The method in accordance with claim 1 comprising a further step of providing a soaker pad having a wad of absorbent material enclosed by an envelope of micro-perforated polyethylene, the envelope having a sealed periphery at which said step of sonic welding is performed.

5. A packaging for meat products and the like, comprising:

(a) an expanded polystyrene tray, said tray having a recess defined therein; and (b) a soaker pad received in said recess, said soaker pad including a polyethylene lamina and being secured to said tray by means of sonic welding of said polyethylene lamina to said tray at a plurality of discrete locations about the periphery thereof.

6. A packaging in accordance with claim 5 wherein said recess is generally rectangular and said soaker pad is sized and shaped to be conveniently received within said recess, and, further, wherein said soaker pad is secured, at each of four corners thereof, to said tray.

7. A packaging in accordance with claim 6 wherein said soaker pad comprises:

(a) a wad of absorbent material;

(b) a micro-perforated polyethylene envelope enclosing said wad and having a sealed periphery at which said envelope is sonic welded to said tray within said recess thereof.

8. A packaging in accordance with claim 5 wherein said soaker pad comprises:

(a) a wad of absorbent material;

(b) a micro-perforated polyethylene envelope enclosing said wad and having a sealed periphery at which said envelope is sonic welded to said tray within said recess thereof.

* * * * *